US005635885A

United States Patent [19]

Sipilä et al.

[11] Patent Number: 5,635,885

[45] Date of Patent: Jun. 3, 1997

[54] RESONATOR SHELL CONSTRUCTION

[75] Inventors: Juha Sipilä, Jääli; Ari Haapakoski, Paavola, both of Finland

[73] Assignee: ADC Solitra Oy, Kempele, Finland

[21] Appl. No.: 382,989

[22] Filed: Feb. 3, 1995

[30] Foreign Application Priority Data

Feb. 11, 1994 [FI] Finland ..... 940663

[51] Int. Cl.[6] ..... H01P 7/06

[52] U.S. Cl. ..... 333/227; 333/230; 333/248; 333/254

[58] Field of Search ..... 333/227, 230, 333/248, 254

[56] References Cited

U.S. PATENT DOCUMENTS

| | | | |
|---|---|---|---|
| 3,137,828 | 6/1964 | Gerig et al. | 333/227 |
| 3,801,939 | 4/1974 | Lamy et al. | 333/254 |
| 3,845,423 | 10/1974 | Scheiner | 333/227 |
| 4,087,768 | 5/1978 | Furneaux | 333/227 |
| 4,167,713 | 9/1979 | Pfitzenmaier | 333/227 |
| 4,180,787 | 12/1979 | Pfitzenmaier | 333/227 |

*Primary Examiner*—Benny Lee
*Assistant Examiner*—Darius Gambino
*Attorney, Agent, or Firm*—Ladas & Parry

[57] ABSTRACT

The invention relates to a resonator shell construction, comprising at least two metallic shell modules (41–44) connected to each other to form a modular shell construction, each module enclosing at least one resonator cavity (42–52). The modules comprise wall portions (41*a*–41*c*, 42*a*–42*c*, 43*a*–43*c*, 44*a*–44*c*) projecting from the modules, said wall portions being connected to one or more modules, whereby one or more new resonator cavities (61–68) are formed between the modules.

10 Claims, 5 Drawing Sheets

RESONATOR SHELL CONSTRUCTION

BACKGROUND OF THE INVENTION

1. Field of the Invention

The invention relates to a resonator shell construction, comprising at least two metallic shell modules connected to each other to form a modular shell construction, each module enclosing at least one resonator cavity.

Resonator constructions are used for implementing high-frequency circuits, for instance in base stations of mobile phone networks. Resonators can be used, for example, as interface and filtering circuits in the amplifiers of transmitter and receiver units in base stations. If the resonator construction comprises several portions, i.e. several resonator cavities, the resonant circuits are connected to one another in such a manner that the resonator construction provides the desired frequency response in the frequency band. This is called sub-band division, in which each resonator cavity covers its own part of the frequency band.

2. Description of the Prior Art

There are several different types of resonators, for example coaxial resonators, helix resonators and cavity resonators. All these three resonator types comprise a metallic shell construction. In coaxial resonators and helix resonators, the shell envelops a conductor which is positioned in the middle of the shell and which can be called, for example, a resonator pin or a resonator conductor. Cavity resonators comprise only a resonator shell.

Resonator shell constructions and individual shell modules for them have been manufactured in many different ways, for instance by bending a thin metal sheet or by milling a solid material. In addition, it is known to manufacture shell modules with one or two cavities by extrusion or die casting. Extrusion, for example, is a good manufacturing method, as it allows the production of long cavity profiles, which are cut into pieces of suitable length, depending on the desired depth of a single cavity.

When the frequency response is to be formed from several portions, it is necessary to use shell constructions comprising several cavities. Shell constructions with several cavities are formed by connecting several shell modules comprising one or more cavities to each other. The properties of a shell construction comprising several cavities—for example, the coupling between Juxtaposed resonator cavities or the resonator conductors in them—can be adjusted by machining the wall between juxtaposed cavities so as to make it lower. The known modular shell constructions are quite simple, since they consist of rectangular shell modules which are connected directly to each other and which are positioned successively or side by side so that the lateral walls of the shell modules are placed against each other. Particular drawbacks of such a construction are the wall between the shell modules, the thickness of the wall, its soldering, and the connection between the modules. If the shell construction, for example, consists of two 2-cavity modules to be juxtaposed, the wall between the modules becomes twice as thick as the wall of a single module; therefore it is more difficult and takes more time to machine the wall between two modules. As stated above, the machining is necessary for adjusting the coupling between the resonator cavities. The different thicknesses of the resonator walls also have a detrimental effect on the electrical behaviour of the resonator, and thus complicate the manufacture of a modular multi-cavity resonator which provides the desired frequency response. The problem with the known shells made by bending a sheet-like material is the need for a large number of soldered joints; a shell construction made from a sheet-like material requires soldered joints not only at the connection between the modules but also within the modules at the points where two different sheet portions are connected to each other.

U.S. Pat. No. 4,087,768 discloses a shell construction consisting of U-shaped portions and separate end portions. However, the separate portions of the construction do not enclose any cavities. The construction is also difficult to assemble.

SUMMARY OF THE INVENTION

The object of the present invention is to provide a new type of resonator shell construction which avoids the problems associated with the known solutions.

This is achieved with a resonator shell construction according to the invention, which is characterized in that said modules, which already enclose a resonator cavity, comprise wall portions projecting from the modules, said wall portions being connected to one or more modules, whereby one or more new resonator cavities are formed between the resonator cavities of the different modules.

In the present shell construction, the shell module is of one piece; it is thus not made from sheet portions by bending or soldering, but it is made e.g. of aluminum by extrusion or die casting. The known extruded shell modules are provided with one or two cavities, and they are strictly rectangular and do not comprise any projecting wall portions, by means of which one module could be connected to another module and thus form new resonator cavities.

The shell construction of the invention has several advantages. The double thickness of the wall between the shell modules is avoided by means of wall portions projecting from the module. As the wall between different modules is not too thick, the wall between the resonator cavities of different modules is easier to machine than in the known solutions in order that the resonator cavities should be connected. The invention allows the modules to bear against each other, or be connected to each other, considerably more easily and with a smaller number of solders. The resonator of the invention is therefore more rapid and less expensive to manufacture. The shell modules employed in the solution of the invention are versatile; different kinds of resonator shells can thus be assembled from the same modules. By extrusion, for example, it is usually possible to produce only pieces whose cross-measure from corner to corner is about 200 mm. The solution of the invention renders it possible to produce, by one extrusion means, a shell module which, when connected preferably to similar modules, allows the manufacture of large shell construction with e.g. 16 cavities. The use of projecting wall portions both increases the number of resonator cavities and facilitates modular extension of the shell construction.

BRIEF DESCRIPTION OF THE DRAWINGS

In the following, the invention will be described in greater detail with reference to the accompanying drawings, in which.

DESCRIPTION OF THE PREFERRED EMBODIMENTS

Figure 1:
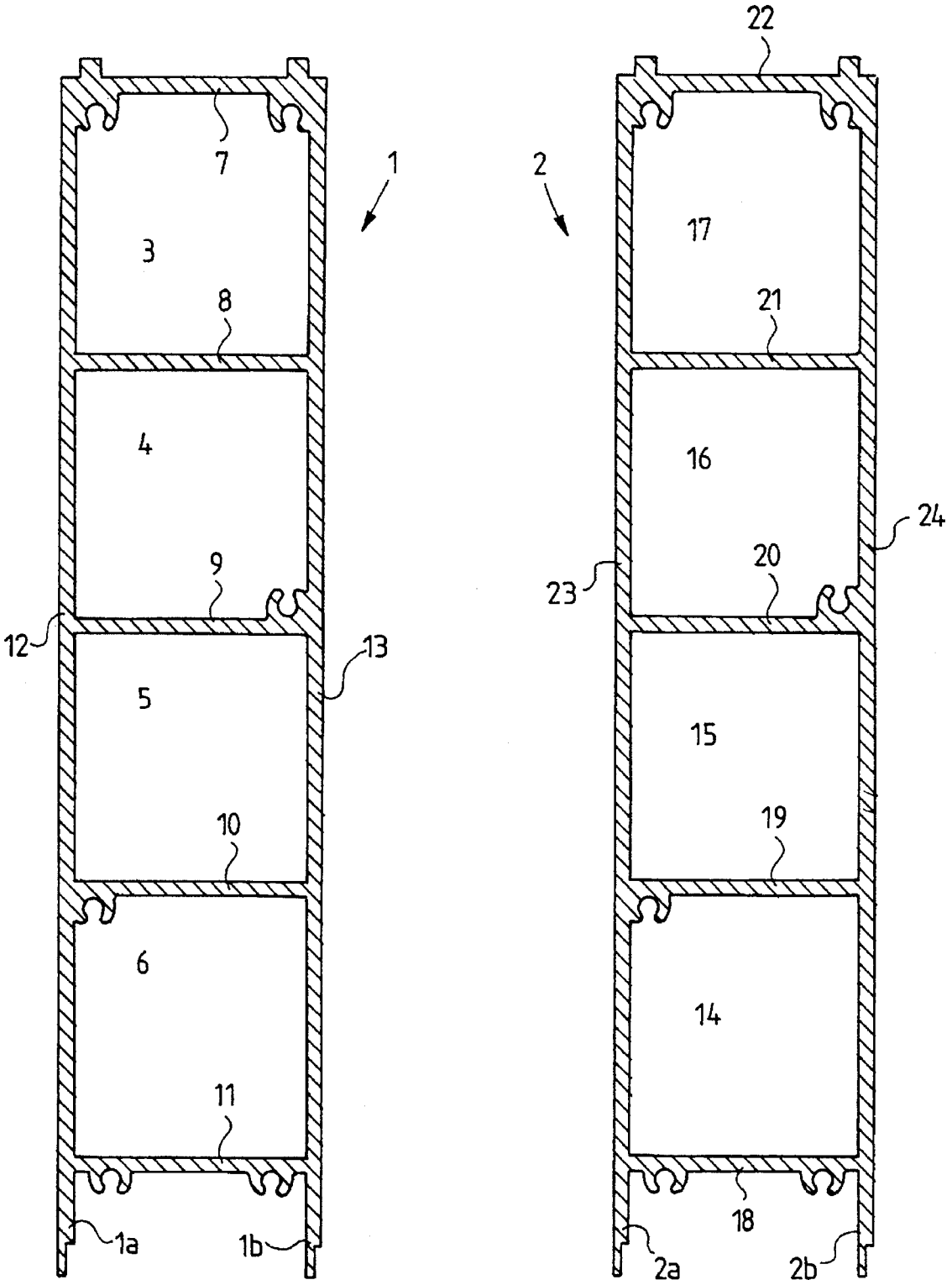
FIG. 1 shows two shell modules with four cavities.

FIG. 1 shows a first embodiment of the invention, comprising substantially identical shell modules 1 and 2. Module 1 encloses four resonator cavities 3 to 6. The resonator cavities 3 to 6 are defined by the horizontal walls 7 to 11 and the vertical walls 12 and 13. Correspondingly, module 2 encloses four resonator cavities 14 to 17. The resonator cavities 14 to 17 are defined by the horizontal walls 18 to 22 and the vertical walls 23 and 24. A modular shell construction can be formed by connecting modules 1 and 2 shown in FIG. 1 to each other. According to the invention, modules 1 and 2 comprise wall portions 1*a*, 1*b*, 2*a*, 2*b* which project from the module and bear against one or more other modules 2 and 1, respectively, forming thus a new resonator cavity. One or more new resonator cavities are formed between the modules, depending on what kind of modules are connected to each other. In the case illustrated in FIG. 1, only one new resonator cavity will be formed; in the case illustrated in FIGS. 2 and 3, three new cavities are formed; and in the case illustrated in FIGS. 4 and 5, eight new cavities are formed. FIG. 1 shows the modules 1 and 2 prior to interconnection, wherefore the connection between the modules and the new resonator cavity cannot be seen. A modular shell construction is assembled by connecting the second module 2 to the first module 1 so that the projecting wall portions 1*a* and 2*b* are abutted against each other, and the projecting wall portions 1*b* and 2*a* are correspondingly abutted against each other. This leads to the formation of a new resonator cavity, defined by the projecting wall portions 1*a*, 1*b*, 2*a* and 2*b* connected to each other and by the horizontal walls 11 and 18. Connecting the two modules shown in FIG. 1, comprising four cavities each, provides a single integral shell construction comprising nine cavities, whereby the frequency response of the resonator consists of nine portions. The distance between the outer surfaces of the short projections provided at the upper end of the module 1, shown in FIG. 1, is selected so that it substantially corresponds to the inner width of the resonator cavity. In the case illustrated, it would thus be possible to connect module 1 to module 2 if module 2 is cut in such a manner that the resonator cavity 14 is open.

Figure 6:
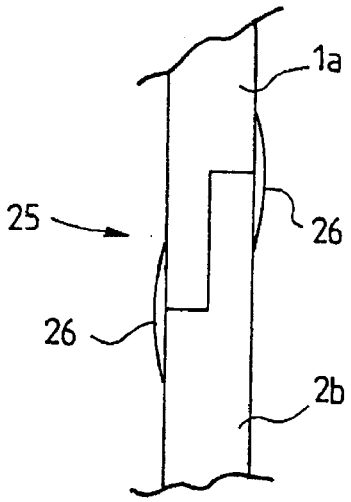
FIG. 6 shows the joint between the projecting wall portions of two modules.

FIG. 6 illustrates the joint 25 between the projecting wall portions, e.g. 1*a* and 2*b*, of two shell modules. At a joint of the type illustrated (joint 25), the projecting wall portions 1*a* and 2*b* bear against each other, and correspondingly, projecting wall portions 1*b* and 2*a* bear against each other. To ensure the electrical behaviour and mechanical resistance of the resonator, the joint is provided with solders 26 or the like.

Each shell module 1, 2 with its projecting wall portions 1*a*, 1*b*, 2*a*, 2*b* is of one piece made either by extrusion or die casting. Connections which require soldering 26 are thus formed only between modules 1 and 2, i.e. at the joint between the projecting wall portions. The actual modules and the resonator cavities 3 to 6 and 14 to 17 enclosed by them do not require any soldering. Soldering is thus required only at the Joints 25 located in the new resonator cavity. A suitable material from which the modules can be made is aluminum. The wall thickness is preferably of the order of 0.5 to 2 mm. On the one hand, the wall of the module should be sufficiently thin to prevent the size of the resonator cavities from being unnecessarily reduced, but on the other hand, it should be sufficiently thick to allow a step-like joint 25, for example, to be formed at the end of the projecting wall portion.

The basic structure of the shell modules is similar even in the cases illustrated in the other figures. The module is thus of one piece; it is not made from sheet portions by bending or soldering, but for instance from aluminum either by extrusion or die casting. It is therefore easy and inexpensive to manufacture, and soldering is required only between the modules.

Figure 2:
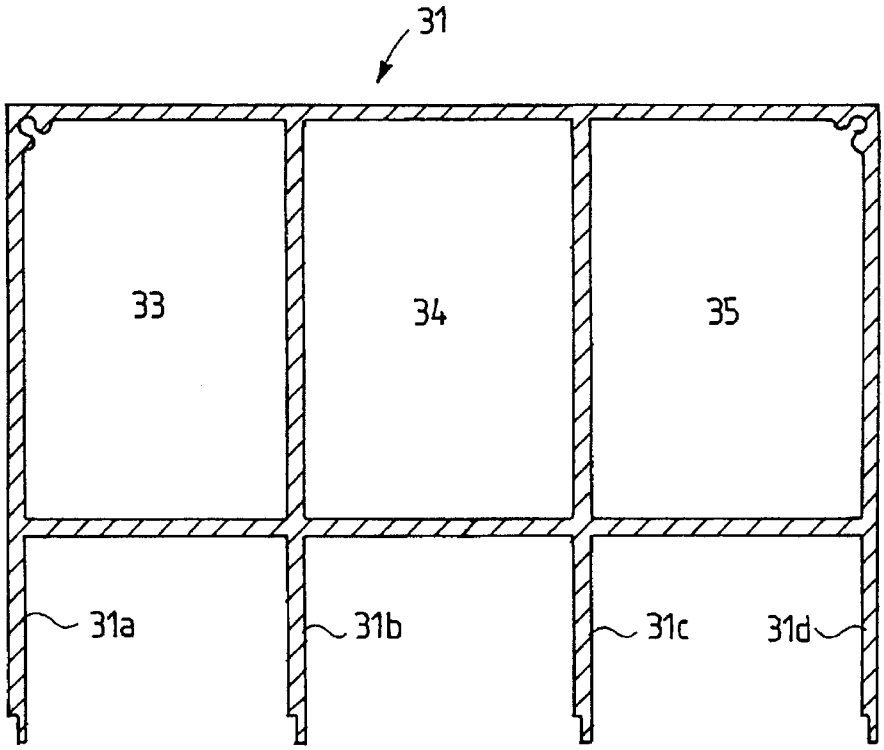
FIG. 2 shows two shell modules with three cavities prior to interconnection.
Figure 2:
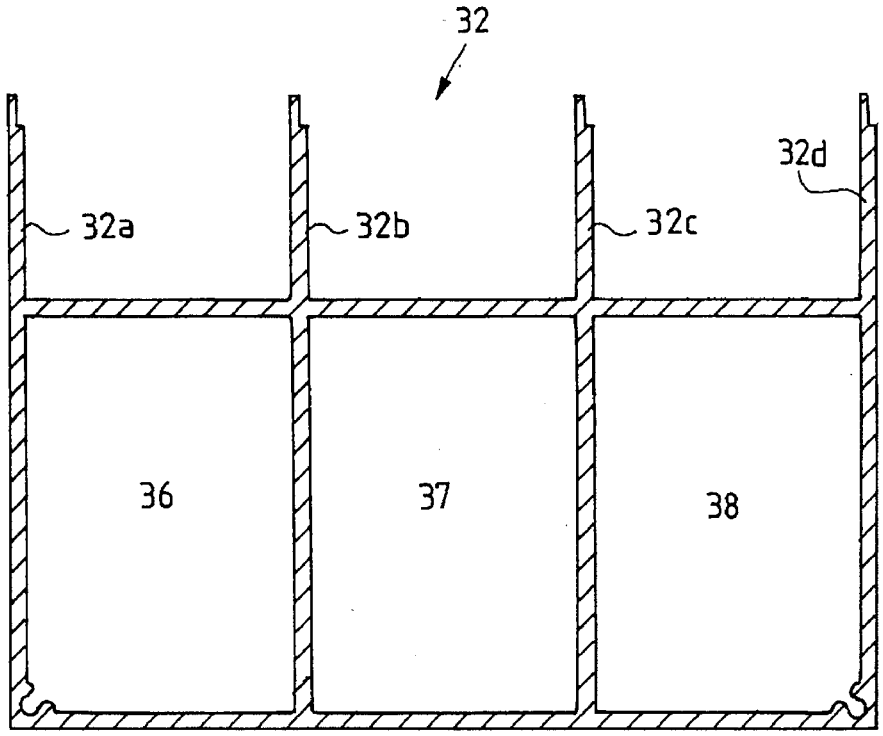
Figure 3:
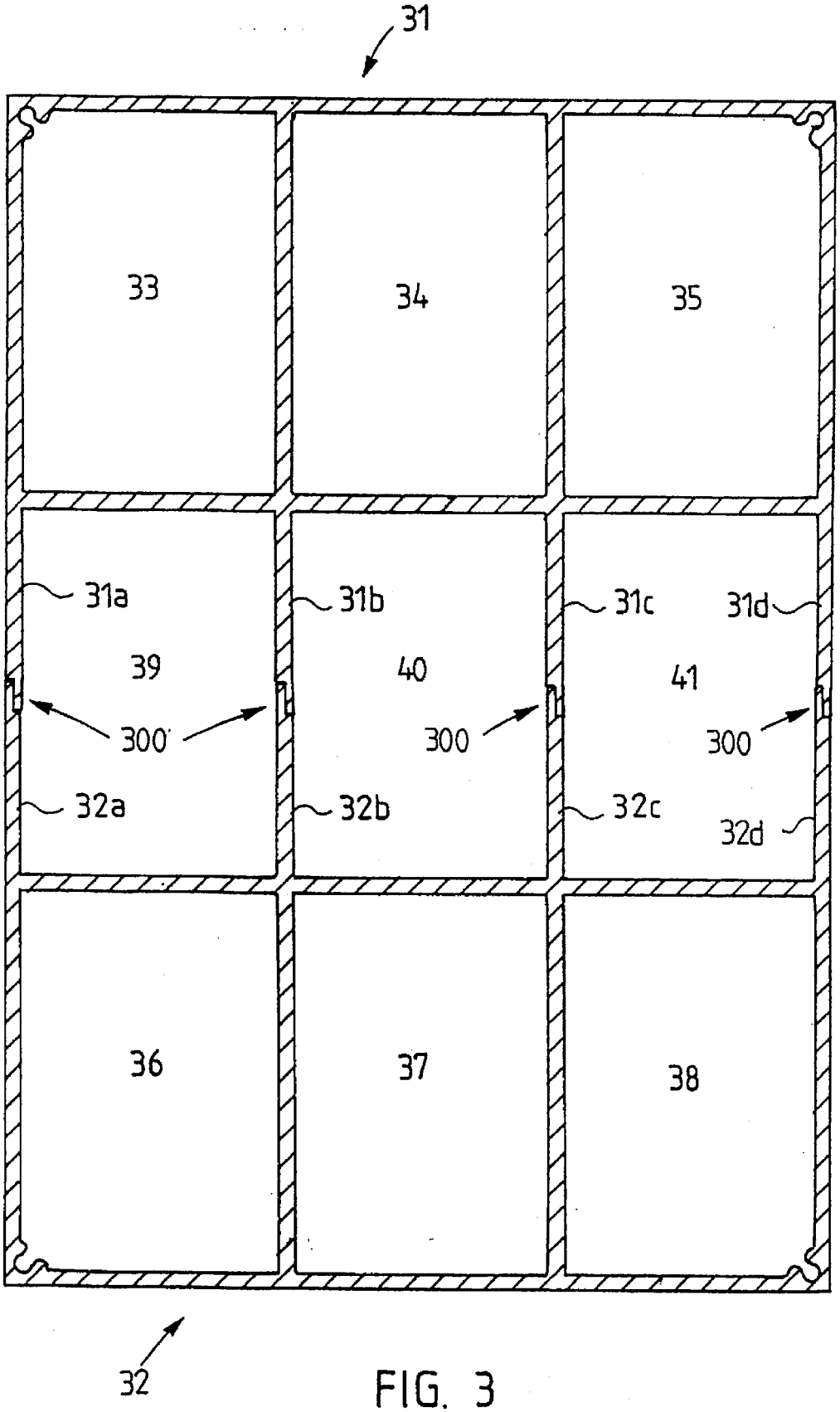
FIG. 3 shows a shell construction formed by combining the modules shown in FIG. 2.

In the following, reference is made to FIGS. 2 and 3, which illustrate another embodiment of the invention. FIG. 2 shows two shell modules 31 and 32 with three cavities prior to interconnection, and FIG. 3 shows a shell construction assembled from modules 31 and 32 of FIG. 2. In FIGS. 2 and 3, module 31 comprises walls which are made, for example, from aluminum and which enclose resonator cavities 33 to 35. In addition, module 31 comprises wall portions 31*a* to 31*d* projecting from the module. Correspondingly, module 32 comprises walls which enclose resonator cavities 36 to 38. In addition, module 32 comprises wall portions 32*a* to 32*d* projecting from the module. The ends of the projecting wall portions 31*a* to 31*d* and 32*a* to 32*d* may be shaped as illustrated in FIG. 6. In FIG. 3, the two modules 31 and 32 are combined into one shell construction. The projecting wall portions 31*a* to 31*d* are connected to the other module 32, more specifically to the corresponding projecting wall portions 32*a* to 32*d* of the other module, forming thus new resonator cavities 39 to 41 between the modules. Two modules with three cavities are thus combined to produce a shell construction with nine cavities. The modules are connected to each other at joints 300.

In the embodiments illustrated in FIGS. 1 to 3, new resonator cavities between shell modules are formed by connecting the projecting wall portions of one module to the substantially parallel projecting wall portions of the other module. In other words, the projecting wall portions of the modules—e.g. 1 and 2, or 31 and 32—are abutted against each other. This embodiment is particularly suitable for an assembly consisting of two modules. The projecting wall portions 31*a* to 31*d* or 32*a* to 32*d* of modules 31 and 32, shown in FIG. 3, make up at least about half of the length of the new resonator cavities; two projecting wall portions abutted against each other—e.g. wall portions 31*a* and 32*a*, and 31*b* and 32*b*—thus make up the entire length of the new resonator cavity, e.g. cavity 39. In a preferred embodiment, the new resonator cavities 39 to 41 are substantially of the same size as the resonator cavities 33 to 35 and 36 to 38 enclosed by the modules 31 and 32. Since the resonator cavities are identical, the electrical behaviour of the resonator can be more easily adjusted.

Figure 4:
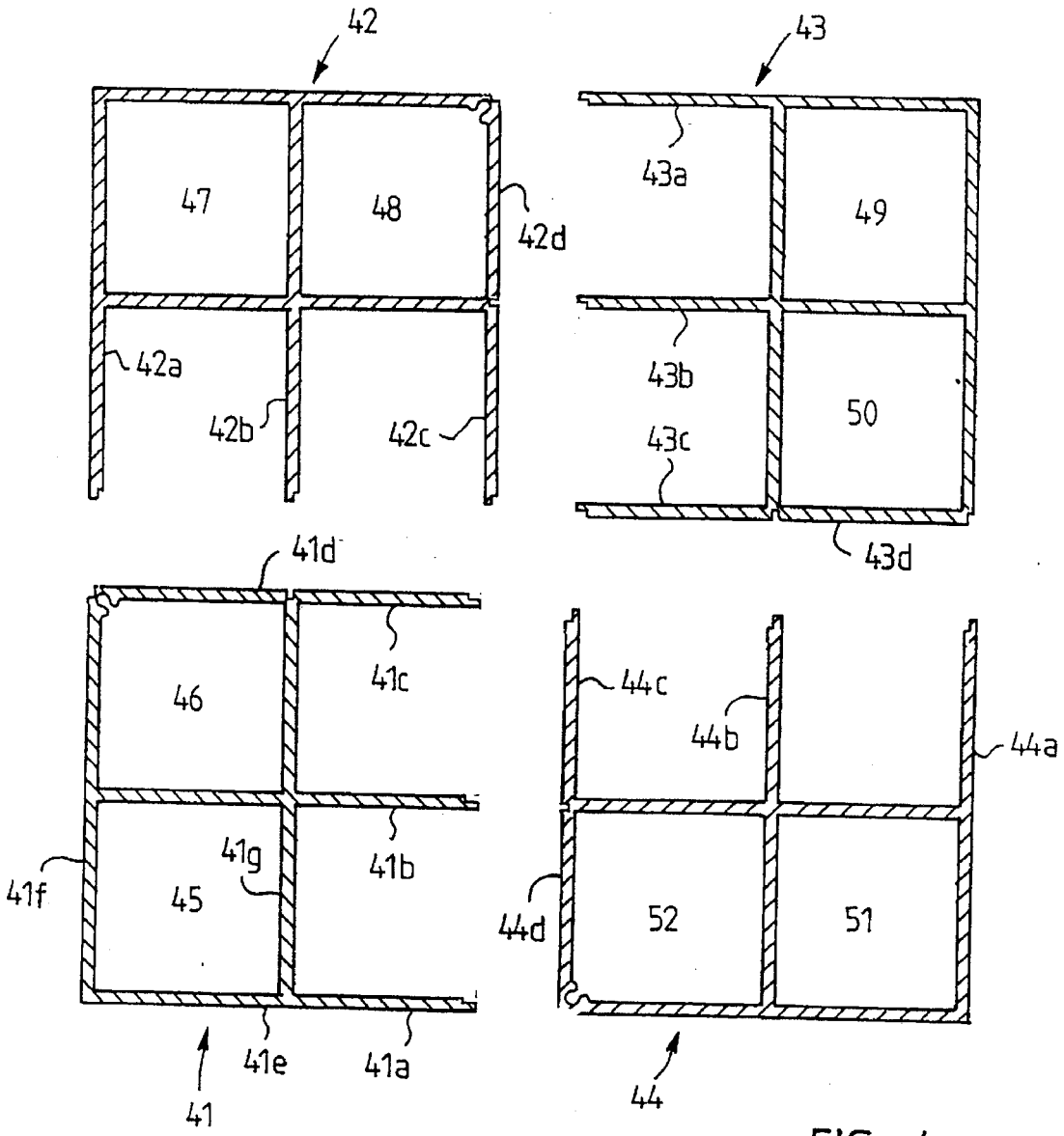
FIG. 4 shows four modules with two cavities prior to interconnection.
Figure 5:
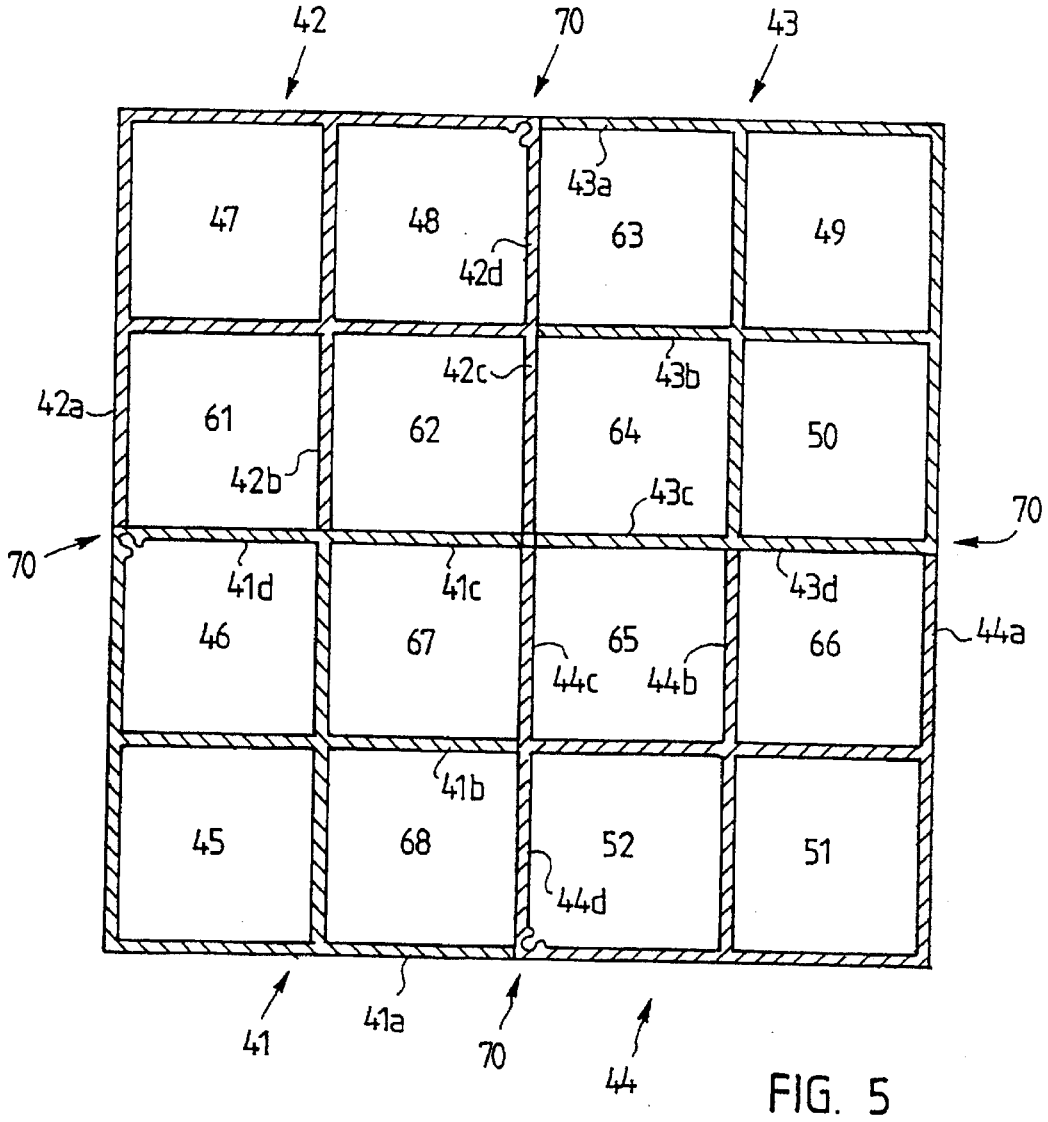
FIG. 5 shows a shell construction formed by combining the modules shown in FIG. 4.

In the following, reference is made to FIGS. 4 and 5. FIG. 4 illustrates four shell modules 41 to 44 with two cavities prior to interconnection, and FIG. 5 shows a shell construction assembled from the modules 41 to 44 of FIG. 4, said construction comprising 16 cavities. In FIGS. 4 and 5, each of the modules 41 to 44 comprises walls which enclose two resonator cavities, i.e. cavities 45–46, 47–48, 49–50 and 51–52. Module 41 comprises projecting wall portions 41*a* to 41*c*, module 42 comprises projecting wall portions 42*a* to 42*c*, module 43 comprises projecting wall portions 43*a* to 43*c*, and module 44 comprises projecting wall portions 44*a* to 44*c*. An exterior wall of each module is indicated by reference numerals 41*d* to 44*d*. In FIG. 5, modules 41 to 44 are combined to form an integral shell construction. In FIG. 5, several new resonator cavities, i.e. cavities 61 to 68, are formed between modules 41 to 44. In the embodiment shown in FIG. 5, the new resonator cavities 61 to 68 between the modules 41 to 44 are formed when the exterior wall of one module is connected to the projecting wall portions of another module, thus enclosing the new cavities. The new resonator cavities 61 and 62 are formed when the exterior wall 41*d* of module 41 is connected to the projecting wall portions 42*a* to 42*c* of module 42. The new resonator cavities 63 and 64 are formed when the exterior wall 42*d* of module 42 is connected to the projecting wall portions 43*a* to 43*c* of module 43. The new resonator cavities 65 and 66 are formed when the exterior wall 43*d* of module 43 is connected to the projecting wall portions 44*a* to 44*c* of module 44. Finally, the new resonator cavities 67 and 68 are formed when the exterior wall 44*d* of module 44 is connected to the projecting wall portions 41*a* to 41*c* of module 41. In the embodiment according to FIGS. 4 and 5, the shell construction comprises at least four modules 41 to 44, each of which comprises at least two resonator cavities 45–46, 47–48, 49–50 and 51–52. Modules 41 to 44 are connected in such a way that at least eight new resonator cavities 61 to 68 are formed between the modules 41 to 44. A shell construction with 16 cavities is thus produced.

From FIG. 5 it can be seen that modules 41 to 44 are positioned with respect to each other in such a way that the direction of the projecting wall portions of a module differs at least about 90 degrees from that of the projecting wall portions of the neighboring module. This can be observed by comparing the positions of modules 41 and 42, for example. Module 42 is identical with module 41, but it has been turned 90 degrees clockwise. Correspondingly, the following module 43 has been turned another 90 degrees clockwise. Module 44, in turn, has been turned 90 degrees clockwise. Finally, module 41 has been turned 90 degrees clockwise with respect to module 44. The direction of projecting wall portions 41*a* to 41*c* differs at least about 90 degrees from that of projecting wall portions 42*a* to 42*c*, which in turn differs at least about 90 degrees from the direction of projecting wall portions 43*a* to 43*c*, which in turn differs at least about 90 degrees from the direction of projecting wall portions 44*a* to 44*c*, which in turn differs at least about 90 degrees from that of projecting wall portions 41*a* to 41*c*.

From FIGS. 3 and 5 it can be seen that the shell construction assembled from modules is substantially rectangular; this is the most efficient shape in view of utilization of space. From FIG. 5 it also appears that, at the centre of the shell construction, the projecting wall portions of the different modules (one projecting wall portion of each module) meet, and thus there is no empty space in the middle of the shell construction.

In a preferred embodiment, the modules are positioned in relation to each other in such a way that the new resonator cavities that are formed in each case are located between only two modules. For example, new resonator cavities 61 and 62 are formed between modules 41 and 42, resonator cavities 63 and 64 are formed between modules 42 and 43, resonator cavities 65 and 66 are formed between modules 43 and 44, and resonator cavities 67 and 68 are formed between modules 44 and 41. This embodiment has the advantage that a resonator cavity has only one neighboring resonator cavity on each side; this allows the electrical behaviour of the resonator to be more easily adjusted.

In FIG. 4, module 41 is provided with reference numerals for wall 41*e* and two other walls 41*f* and 41*g*. In a preferred embodiment, the projecting wall portions 41*a* to 41*c* of module 41 are substantially parallel to first walls 41*d* and 41*e* of the resonator cavities enclosed by the module, and substantially perpendicular to second walls 41*f* and 41*g* of the resonator cavities enclosed by the module.

In a preferred embodiment, the number and length of the projecting wall portions 41*a* to 41*c* of module 41, for example, are selected so that the new resonator cavities to be formed between the modules will be substantially of the same size as the resonator cavities already enclosed by the modules. If the cavities are of the same size, the quality factor, or Q factor, of the resonator is evenly divided between the different resonator cavities. In FIG. 5, all resonator cavities 45 to 52 and 61 to 68 are substantially of the same size and of the same shape.

In a preferred embodiment, the projecting wall portions, e.g. wall portions 41*a* to 41*c*, are substantially equally long; this makes the modules more applicable for use in the manufacture of various kinds of shell constructions. The fact that the resonator modules are substantially identical with each other also contributes to this and, moreover, reduces the manufacturing costs and assembly costs of the shell construction. From the figures it can be seen that even the projecting wall portions of different modules are equally long.

Figure 7:
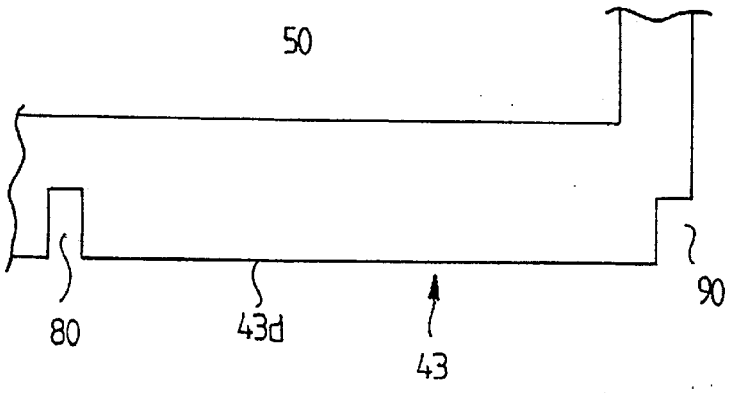
FIG. 7 shows recesses provided in the exterior wall of a module.

FIG. 5 shows that the outermost projecting wall portion of one module is connected to the corner of another module at a joint 70. The projecting wall portions 41*b* to 44*b* in the middle of the modules, in turn, are connected to the walls 41*d* to 44*d* of other modules. The innermost projecting wall portions 41*c* to 44*c* are connected to each other at the center of the shell construction. FIG. 7 illustrates the recesses 80 and 90 provided in wall 43*d* for connecting the two modules 44 and 43. The recess 80 in the exterior wall 43*d* of module 43, preferably in the middle of the exterior wall, is intended for the projecting wall portion 44*b* of module 44, whereas the recess at the corner of module 43 is intended for the outermost projecting wall portion 44*a* of module 44. The joints 70 at the outer edge of the shell construction illustrated in FIG. 5 are always located between a projecting wall portion and the corner of the neighboring module. From the figure it also appears that, on each side of the shell construction, the outer surfaces of at least two modules are substantially on a level with each other, and thus the shell construction has an even outer surface.

The projecting wall portions are straight and even planar portions. The cavities enclosed by the modules and the new cavities formed between different modules are quadrangles with a regular shape and an even surface. The junctions between different modules are on a level defined by the walls of the modules. The advantages of the invention appear particularly clearly from these preferred embodiments.

Although the invention is described above with reference to the examples illustrated in the drawings, it will be clear that the invention is not limited to the examples, but can be modified in many ways within the inventive concept disclosed in the appended claims.

We claim:

1. A shell construction for resonators, comprising:

first and second metallic-shell modules each of the modules comprising first walls and second walls for defining at least one resonator cavity in each of the modules; and wall means projecting from the modules for the wall means of at least the first of the modules to connect to the second of the modules to define at least one new resonator cavity between the cavities of the modules.

2. The resonator shell construction according to claim 1, wherein each of the modules is of one piece made by extrusion.

3. The resonator shell construction according to claim 1, wherein the wall means of the modules are substantially parallel to the first walls of the respective modules.

4. The resonator shell construction according to claim 1, wherein both number and length of the wall means are selected so that the new resonator cavity is substantially of the same size as the resonator cavities.

5. The resonator shell construction according to claim 1, wherein the first and second modules are substantially identical with each other.

6. The resonator shell construction according to claim 1, wherein the wall means of the modules are substantially equally long.

7. The resonator shell construction according to claim 1, wherein the wall means of the modules are connected and substantially parallel when the modules are connected.

8. The resonator shell construction according to claim 1, wherein (a) the wall means and one of the second walls of the first module and (b) one of the first walls and wall means of the second module define the at least one new resonator cavity as two new resonator cavities when the modules are connected.

9. The resonator shell construct from according to claim 8, wherein the wall means of the modules respectively project at least about 90 degrees from each other when the modules are connected.

10. The resonator shell construction according to claim 3, wherein the wall means of the modules are substantially perpendicular to the second walls of time respective modules.

* * * * *